United States Patent [19]

Cuvilly

[11] 4,041,658

[45] Aug. 16, 1977

[54] CEILING EQUIPMENT FOR DEMONSTRATION EQUIPMENT

[75] Inventor: Jean-Pierre Cuvilly, Chennevieres-sur-Marne, Germany

[73] Assignee: E. Kalinna, Germany

[21] Appl. No.: 574,707

[22] Filed: May 5, 1975

[30] Foreign Application Priority Data

May 7, 1974 Germany ..... 2425633

[51] Int. Cl.[2] ..... G09F 7/20

[52] U.S. Cl. ..... 52/39; 52/64; 52/475; 52/511

[58] Field of Search ..... 16/96 D; 52/22, 64, 52/475, 488, 484, 489, 511, 386, 495, 624, 39

[56] References Cited

U.S. PATENT DOCUMENTS

| | | | |
|---|---|---|---|
| 2,910,738 | 11/1959 | McCorkell | 52/484 X |
| 3,127,926 | 4/1964 | Adelt | 52/624 X |
| 3,181,274 | 5/1965 | Izenour | 52/39 X |
| 3,312,027 | 4/1967 | Lawer | 52/475 |
| 3,313,075 | 4/1967 | Buchmeier | 52/489 |
| 3,321,223 | 5/1967 | Snow et al. | 52/511 X |
| 3,417,534 | 12/1968 | McDermott | 52/624 |
| 3,485,519 | 12/1969 | Chiu | 52/475 X |
| 3,521,419 | 7/1970 | Fornells | 52/386 X |
| 3,685,235 | 8/1972 | Lang | 52/488 X |
| 3,706,171 | 12/1972 | Shayman | 52/511 X |
| 3,742,674 | 7/1973 | Lang | 52/39 X |
| 3,745,736 | 7/1973 | Fischer et al. | 52/511 |
| 3,748,793 | 7/1973 | Tompkins et al. | 52/64 |

FOREIGN PATENT DOCUMENTS

| | | | |
|---|---|---|---|
| 187,131 | 1/1964 | Sweden | 52/495 |
| 392,825 | 10/1965 | Switzerland | 52/511 |
| 896,576 | 5/1962 | United Kingdom | 52/489 |

*Primary Examiner*—Leslie A. Braun

*Attorney, Agent, or Firm*—Kane, Dalsimer, Kane, Sullivan and Kurucz

[57] ABSTRACT

A ceiling construction for demonstration equipment comprises a number of rectangular panels which between them define guide slots for a sliding link chain which will carry samples. The panels are supported by parallel rails which carry undercut longitudinal grooves on their lower sides for the receipt of clamping elements carried on the upper surfaces of the panels, the disposition of the grooves and clamping elements being such as to maintain a desired width along the length of the slots. Adjacent panels may be spaced as required in the longitudinal direction of the grooves by longitudinally positioned spacing pieces positioned in the grooves.

6 Claims, 5 Drawing Figures

FIG. 3
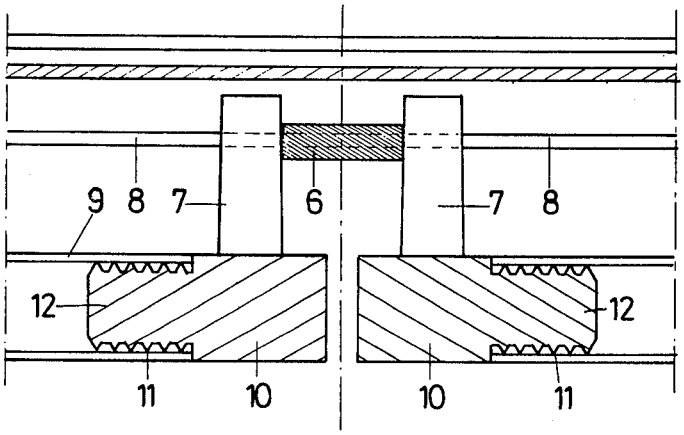
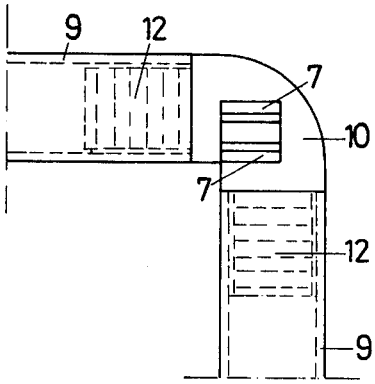
FIG. 4
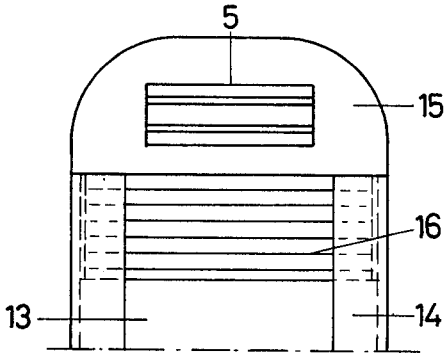
FIG. 5

CEILING EQUIPMENT FOR DEMONSTRATION EQUIPMENT

This invention relates to a ceiling construction for supporting movable demonstration equipment, such as may be used in sales rooms for household textiles, such as curtains and draperies. Such constructions are usually composed of rectangular panels which bound intersecting gaps, which provide a guide slot for a movable jointed chain which will carry the sample to be shown.

In a well known ceiling of this type frames for the rectangular panels are suspended individually at their respective end points by means of suspension bolts from a supporting structure. The assembly of such a ceiling often proves to be laborious and time-wasting, as the drillings for the suspension bolts have to be very accurate in order always to ensure the same correct distance between adjoining panels, so that the guide slots for the jointed chain formed thereby, are sufficiently large that the jointed or link chain cannot jam, yet sufficiently small so that the chain cannot drop out. Moreover, for the assembly of this ceiling a good deal of screwing work is needed.

It is an object of this invention to provide a built-in ceiling construction which may be assembled easily and rapidly.

According to the invention, there is provided a ceiling construction for demonstration equipment and comprising rectangular panels which bond adjacent intersecting guide slots or gaps in which will slide a link chain for carrying the samples to be shown, and a supporting structure of parallel rails having, on the lower side, parallel undercut longitudinal grooves for accomodating clamping elements arranged on the panels, and spaced apart in such a manner that the gap between the edges of adjacent panels, which will accomodate the link chain, will be maintained.

During the assembly of the ceiling construction according to the invention hereinbefore defined, first of all the supporting structure is mounted in the space to be equipped with the ceiling construction. This can take place very quickly, since the pieces concerned are large, and their longitudinal dimensions can correspond to the length or width of the room in question. After the suspension of the supporting structure, the individual panels only have to be clipped by means of their clamping elements onto the rails and moved along these rails into the desired positions, ideally with the aid of spacing pieces, until they are at the right distance from the adjacent panels. These spacing pieces will be provided between the longitudinal grooves to achieve a desired spacing between the adjacent panels in the longitudinal direction of the longitudinal grooves.

The clamping elements are provided for preference on two mutually opposite edges of each panel. It is particularly desirable to design the clamping elements as corner pieces which join together two parts of the frame forming two adjacent side edges of a panel. In this way, as required, it is possible to provide panels of any desired width directly at the assembly point by the use of corresponding lengths of frame parts. This possibility is furnished in particular when the frame parts are tubular and the clamping elements have end portions disposed at right angles to one another and provided with peripheral ribs which are inserted non-positively in the ends of the tubular frame parts.

A storage section for textiles to be shown can be provided by means of a series of adjacent oblong boards of U-shaped cross-section, the clamping elements being inserted non-positively in the opposite ends of tbe oblong board.

Preferably, the clamping elements are formed from a resilient plastics material such as polyamide or polyacetal resin, and will have two divergent clamping tongues each containing, on their side surfaces facing away from one another, a groove which engages within a bent over edge of the respective undercut longitudinal groove. By means of this design the clamping elements can, without difficulty, be pressed from below into the longitudinal grooves of the rails.

The suspension of the rails can take place in various ways. For instance, the rails may have an undercut longitudinal groove on their upper side for slidable engagement with a suspension device. In another possible construction the rails are arranged rigidly on a suspended structure which can be arranged on the roof of the room. Finally, the rails can be arranged rigidly on a self-supporting structure, which spans the width or length of the room being equipped.

In order that the invention may be fully understood, a preferred embodiment thereof will now be described by way of example, with reference to the accompanying drawings in which:

FIG. 3 is a section along the line 3—3 of FIG. 1 on an enlarged scale;

FIG. 4 is a view from above onto the corner of a panel of FIG. 1; and

FIG. 5 is an end of a narrow panel of FIG. 1 seen from above.

Figure 1:
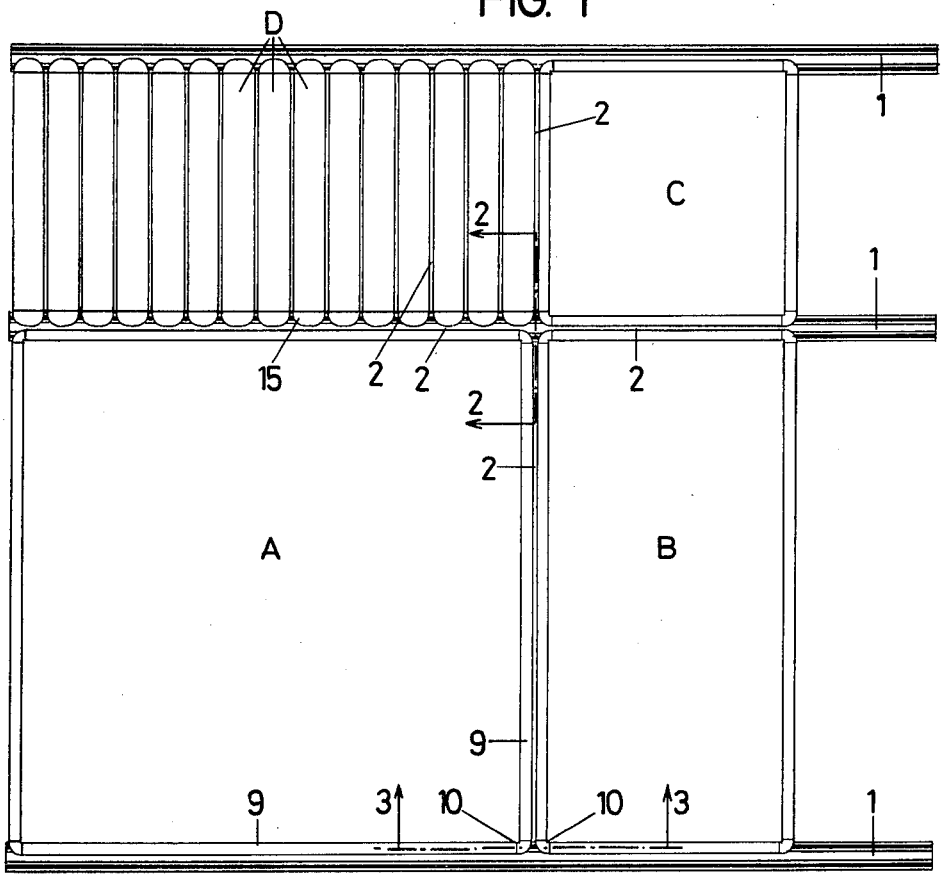
FIG. 1 illustrates a portion of a built-in ceiling construction according to the invention seen from below.

The built-in ceiling construction which is represented in FIG. 1 has a supporting structure which consists of a large number of rails disposed parallel to one another, and whose distance apart corresponds to the desired dimensions of the panels in one direction. In the embodiment represented, there are bays A, B, C, D of different dimensions, whose mutually adjacent edges form intersecting guide slots 2 in which moves a link chain 3 carrying a sample to be demonstrated. For attachment of the panels A, B, C and D, rails 1 have two parallel undercut longitudinal grooves 4 on their lower side which serve to accommodate clamping elements 5 arranged on the panels. The distance between the longitudinal grooves 4 of each rail is dimensioned in such a way that the mutually adjacent edges of the panels which are arranged on the rail in question are at the distance apart which is needed for guiding and supporting the link chain 3. In order to be able to ensure the right distance between the adjacent panels located side by side, between the same pair of rails i.e. for instance between the panels A and B, spacing or distance pieces 6 are provided which lie between the adjacent clamping elements 5 in a longitudinal groove.

The clamping elements 5 consist, for preference, of solid but resilient plastics material such as a polyamide or polyacetal resin. They have two divergent clamping tongues 7 each of which contains, on their side surfaces facing away from one another, a groove which engages in the bent over edge 8 of the respective inturned portion of the longitudinal groove 4. The spacing pieces 6 are provided with corresponding grooves for gripping round the edges 8.

The panels A, B and C in the embodiment shown comprise tubular frame parts 9 which are joined together by means of corner pieces 10 which carry the clamping elements 5. As may be seen in particular from FIGS. 3 and 4 the corner pieces 10 have end portions 12 disposed at right angles to one another and provided with peripheral ribs 11. These end portions 12 are inserted, non-positively into the ends of the frame parts 9. The space contained within the frame parts 9 can be filled with inserted plates or the like which may provide a desired optical effect.

The panels D have a rather different structure in that they consist of oblong boards 13 of U-shaped cross-section thus forming bent over longitudinal edges 14 as shown in FIG. 5. The ends of the oblong board that are opposite one another are sealed by terminal pieces 15 which suport clamping elements 5, and which are in their turn inserted non-positively in the ends of the board 13, as may be seen from FIG. 5. The terminal pieces 15 are in one piece with the clamping elements 5.

Figure 2:
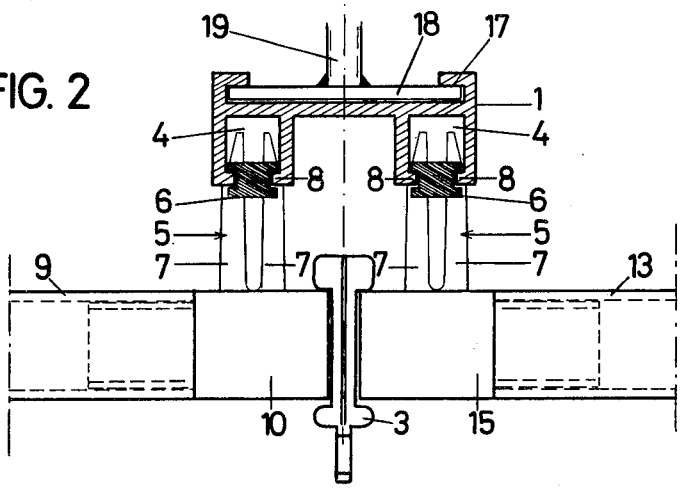
FIG. 2 is a section along the line 2—2 of FIG. 1.

The assembly of the rails 1 can take place in different ways. In the embodiment illustrated in FIG. 2 the rails 1 have, on their upper surface, an undercut longitudinal groove 17, in which a plate 18 can be slidably engaged. The plate 18 is carried by a suspension device 19 on the ceiling of the room. Alternatively the rails may be attached rigidly to a suspended structure that can be arranged on the ceiling of the room, or onto a self-supporting structure.

The assembly of the built-in ceiling construction shown in the drawings takes place in such a way that first of all the supporting structure, i.e. the rails 1, are mounted at the desired distance in the room to be equipped. Then the individual panels A, B, C and D, constructed in accordance with desired requirements, are assembled in their respective widths, (i.e. in their extent along the rail 1) and are attached firmly and reliably from below by forcing their clamping elements 5 into the longitudinal grooves 4. In order to maintain the distance that is needed for guiding the link chain 3 between neighbouring panels in the longitudinal direction of the rails 1, the spacing pieces 6 are inserted as described above.

I claim:

1. A suspended ceiling construction for demonstration equipment and comprising rectangle panels having mutually adjacent edges which define intersecting guide slots in which slides a link chain for carrying samples to be shown, said link chain having a laterally enlarged upper head which is supported on the upper surface of the panels close to their edges, and a supporting structure for the panels composed of parallel rails which each have on its lower side two parallel longitudinal undercut channels facing downwardly, clamping elements arranged on the panels in spaced relationship along the edges thereof parallel to said rails and channels and extending upwardly from the upper surfaces of the panels to be snapped into the undercut channels, said clamping elements being spaced from the edges of the panels to leave space for the head of the link chain, the distances between the channels of one rail and of each clamping element from the edge of the associated panel being such that the slots between the edges parallel to said rails of adjacent panels will be maintained at a width sufficient to accommodate the link chain, and spacing pieces in the longitudinal channels between the clamping elements of adjacent panels to determine between the edges, normal to the longitudinal channels, of adjacent panels a slot for accommodating the link chain.

2. A ceiling construction according to claim 1, wherein frame parts form side edges of the panels, a clamping element is provided at each corner of a panel and each clamping element is in the form of a corner piece which joins together two frame parts forming adjacent side edges of a panel.

3. A ceiling construction according to claim 2, wherein the frame parts are tubular and the corner pieces have end portions diposed at right angles to one another and provided with peripheral grooves which are inserted non-positively in the ends of the tubular frame parts.

4. A ceiling construction according to claim 1, wherein at least some panels are formed as an oblong board of U-shaped cross-section thus forming bent over longitudinal edges, and terminal pieces which carry the clamping elements are inserted non-positively in the opposite ends of the oblong board.

5. A ceiling construction according to claim 1, wherein the clamping elements consist of a resilient plastics material.

6. A ceiling construction according to claim 1, wherein each longitudinal groove forms bent over inturned edges and the clamping elements comprise two divergent clamping tongues having side surfaces which face away from one another, which side surfaces each have a groove to engage within the bent over edge of the respective undercut longitudinal groove.

* * * * *

UNITED STATES PATENT OFFICE

CERTIFICATE OF CORRECTION

PATENT NO. : 4,041,658

DATED : August 16, 1977

INVENTOR(S) : JEAN-PIERRE CUVILLY

It is certified that error appears in the above-identified patent and that said Letters Patent are hereby corrected as shown below:

Inventor: Jean-Pierre Cuvilly resides at Chennevieres-sur-Marne, --France-- instead of "Germany".

Signed and Sealed this

*Twelfth* Day of *September 1978*

[SEAL]

*Attest:*

RUTH C. MASON
*Attesting Officer*

DONALD W. BANNER
*Commissioner of Patents and Trademarks*